US005517088A

United States Patent [19]

Blom

[11] Patent Number: 5,517,088

[45] Date of Patent: May 14, 1996

[54] UNIVERSAL IGNITION CIRCUIT FOR HIGH PRESSURE DISCHARGE LAMPS

[75] Inventor: Anton C. Blom, Eindhoven, Netherlands

[73] Assignee: U.S. Philips Corporation, New York, N.Y.

[21] Appl. No.: 862,020

[22] Filed: Apr. 2, 1992

[30] Foreign Application Priority Data

Apr. 4, 1991 [EP] European Pat. Off. ..... 91200781

[51] Int. Cl.[6] ..... H05B 37/00

[52] U.S. Cl. ..... 315/289; 315/307

[58] Field of Search ..... 315/227 R, 238, 315/289, 291, 307, 362

[56] References Cited

U.S. PATENT DOCUMENTS

| | | | |
|---|---|---|---|
| 4,072,878 | 2/1978 | Engel et al. | 315/289 X |
| 4,143,304 | 3/1979 | Hitchcock et al. | 315/289 X |
| 4,339,695 | 7/1982 | Siglock | 315/289 X |
| 4,461,982 | 7/1984 | Fahnrich | 315/289 X |
| 4,958,107 | 9/1990 | Mattas et al. | 315/289 |
| 5,047,694 | 9/1991 | Nuckolls et al. | 315/289 X |

FOREIGN PATENT DOCUMENTS

| | | |
|---|---|---|
| 0222441 | 5/1987 | European Pat. Off. . |
| 3339814 | 7/1984 | Germany . |

*Primary Examiner*—Robert Pascal
*Assistant Examiner*—Michael Shingleton
*Attorney, Agent, or Firm*—Edward Blocker; Bernard Franzblau

[57] ABSTRACT

A circuit arrangement (II) for igniting a high-pressure discharge lamp provided with a pulse transformer, a switching device and a capacitive element for a periodic charge inversion via the transformer and the switching device. The circuit arrangement is also provided with a peak current limiting impedance to protect the switching device. A voltage limiting device is added to the transformer. By the provision of the voltage limiting device, the lamp ignition is to a high degree made to be independent of lamp connection line impedances.

15 Claims, 1 Drawing Sheet

UNIVERSAL IGNITION CIRCUIT FOR HIGH PRESSURE DISCHARGE LAMPS

BACKGROUND OF THE INVENTION

This invention relates to a circuit arrangement suitable for igniting a high-pressure discharge lamp. The circuit arrangement is provided with transformer means, switching means and capacitive means for periodic charge change via the transformer means and switching means, and also provided with peak current limiting means to protect the switching means. The invention also relates to a lamp operating circuit provided with such a circuit arrangement.

A circuit arrangement of the kind mentioned in the opening paragraph is known from DE-OS 33 39 814. The peak current limiting means there takes the form of a coil. Another possibility is to use a resistor as the peak current limiting means. Combinations of the said means are also possible.

The known circuit arrangement is very suitable for igniting high-pressure discharge lamps, such as metal halide lamps and high-pressure sodium lamps. A primary part of the transformer means is then included in an electric circuit which comprises both the capacitive means and the switching means. A voltage pulse generated in this circuit as a result of the switching means becoming conductive and the ensuing charge change of the capacitive means is transformed in the transformer means into a high voltage pulse at a secondary part, to which the lamp to be ignited is connected.

Although the peak current limiting means influence the level of an ignition pulse generated in the transformer means, this pulse level will be to a considerable degree dependent on the load on the transformer means. The transformer load is made up of the connected lamp including the connection lines.

In particular, the impedance formed by the connection lines is of major importance. The application possibilities of the known circuit arrangement are limited by this. Thus, if the circuit arrangement is dimensioned so as to ignite a lamp with comparatively long connection lines, so a comparatively great impedance, this circuit arrangement will not be suitable for igniting a similar lamp with comparatively short connection lines, since the ignition pulses will then become considerably higher than can be safely allowed. Conversely, a circuit arrangement dimensioned so as to ignite a lamp via comparatively short connection lines will generate ignition pulses which are insufficiently high for igniting a similar lamp with the use of comparatively long connection lines.

SUMMARY OF THE INVENTION

The invention has for an object, inter alia to provide a measure by which the described disadvantage can be eliminated. For this purpose, a circuit arrangement according to the invention is characterized in that voltage limiting means are added to the transformer means.

The measure according to the invention makes it possible to dimension the circuit arrangement in such a way that it is suitable for reliably igniting lamps which are connected through comparatively long connection lines. Owing to the presence of the voltage limiting means, the level of the ignition pulses will remain limited in the case of short connection lines so that no unsafe situations are created. An additional advantage is that the transformer means become much less quickly saturated than in the case in which the known circuit arrangement is used. Thus a pulse width necessary for igniting the lamps is maintained as well.

The voltage limiting means can be realized in a particularly simple, and thus advantageous manner in that at least two zener diodes are connected in series with opposite polarities as a voltage limiting short-circuit across the transformer means. The short-circuit may be placed across the secondary part of the transformer means. This has the advantage that the high voltage pulse is directly limited, but it involves the requirement that the zener diodes must stand up to high voltages. In practice this means a voltage of 3 to 4 kV. If the short-circuit is placed across the primary part of the transformer means, however, the zener diodes are loaded with a considerably lower voltage so that less stringent requirements are imposed on the zener diodes in this respect. This renders it possible to use zener diodes of a comparatively inexpensive kind.

In practice, supplementary capacitive means have been connected across the transformer means in the known circuit arrangement. This does reduce the influence of the connection line impedance on the ignition pulse level, but it does not eliminate the described disadvantage. In addition, the capacitance thus used forms an additional impedance both during lamp ignition and during stable lamp operation.

BRIEF DESCRIPTION OF THE DRAWING

An embodiment of a circuit arrangement according to the invention will be described in more detail with reference to the accompanying drawing, in which.

DESCRIPTION OF THE PREFERRED EMBODIMENTS

Figure 1:
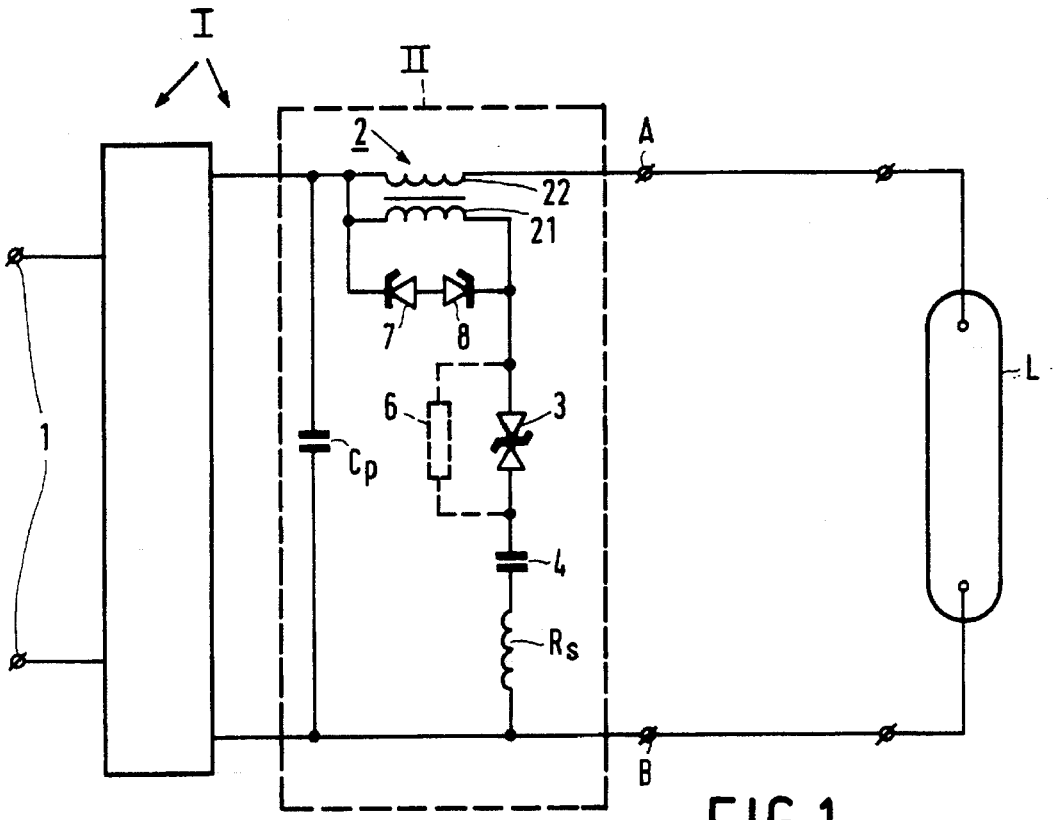
FIG. 1 is a diagram of a lamp operating circuit provided with a circuit arrangement according to the invention.

In FIG. 1, a circuit arrangement II forms part of an electronic lamp operating circuit I provided with connection terminals 1 for connecting a supply source, for example, an AC voltage source of 220 V, 50 Hz and provided with lamp connection terminals A, B to which a lamp L is connected. The circuit arrangement II comprises a transformer 2 as the transformer means, a breakdown element 3 as the switching means, and a capacitor 4 as the capacitive means for periodic charge change in the form of a charge inversion via transformer 2 and breakdown element 3. The transformer 2 comprises a primary winding 21 as a primary part and a secondary winding 22 as a secondary part. An impedance $R_s$ is also included as a peak current limiting means to protect the switching means. Preferably, impedance $R_s$ is designed as a self-inductance, although alternatively a resistor or combinations thereof are possible. A resistor 6, which serves to ensure that the circuit arrangement will become operational after the supply source has been connected, is connected across breakdown element 3. Voltage limiting means in the form of zener diodes 7, 8 connected in series with opposite polarities shunt the transformer 2 as the voltage limiting short-circuit. The circuit arrangement II may also be provided with a capacitor $C_p$, which safeguards a defined current path in the case of breakdown of the switching means. If the circuit arrangement is used in an electronic lamp operating circuit, the use of capacitor $C_p$ may be dispensed with, since such a lamp operating circuit contains sufficient capacitive means for safeguarding the desired current path in the case of breakdown of the breakdown element 3.

The use of the separate capacitor $C_p$, however, is desirable if the circuit arrangement II is used in a conventional lamp operating circuit.

The embodiment described is particularly suitable for use in a lamp operating circuit in the form of a high-frequency switch mode power supply (SMPS) which supplies a square-wave voltage to the lamp. The configuration described realizes substantially a doubling of the voltage across breakdown element 3 without requiring further auxiliary means. This renders it possible to choose the breakdown voltage of the breakdown element 3 to lie at such a level that it is certain that no breakdown can occur during stable lamp operation.

A practical embodiment of the lamp operating circuit described was tested for the ignition of a metal halide lamp of a power rating of 70 W. The lamp operating circuit was realized in the form of a high-frequency switch mode power supply, comprising an up-converter for transforming the AC voltage of 220 V, 50 Hz which serves as the supply source to a DC voltage of 385 V, followed by a down-converter as the current source for operating the lamp included in a commutator network. The inclusion of the lamp in a commutator network serves to counteract the occurrence of cataphoresis during lamp operation. The circuit arrangement for igniting the lamp was included in the commutator network. The primary winding 21 of transformer 2 had 9 turns, and the secondary winding 22 had 270 turns. The zener diodes 7, 8 were of the BZT 03C 120 type with a breakdown voltage of 120 V. The breakdown element 3 was constructed as a series circuit of two sidacs, one of the K 1V 24 type and one of the K IV 16 type, with a joint breakdown voltage of 400 V. The K IV 24 type sidac was shunted by a resistor of 27 kΩ, and the K IV 16 type sidac was shunted by a resistor of 18 kΩ. Impedance $R_s$ was a self-inductance of 13.5 μH and capacitor 4 had a capacitance of 150 nF.

Immediately after connection of the lamp operating circuit to the supply source, a square-wave voltage of 300 V is across the circuit arrangement, consecutive square waves having different polarities. The commutation frequency is approximately 100 Hz. The result is that the breakdown element 3 breaks down at the second square wave and that a charge inversion across capacitor 4 takes place via primary winding 21 and self-induction coil $R_s$. This supplies a pulse level of 4 kV at the secondary winding 22.

Figure 2:
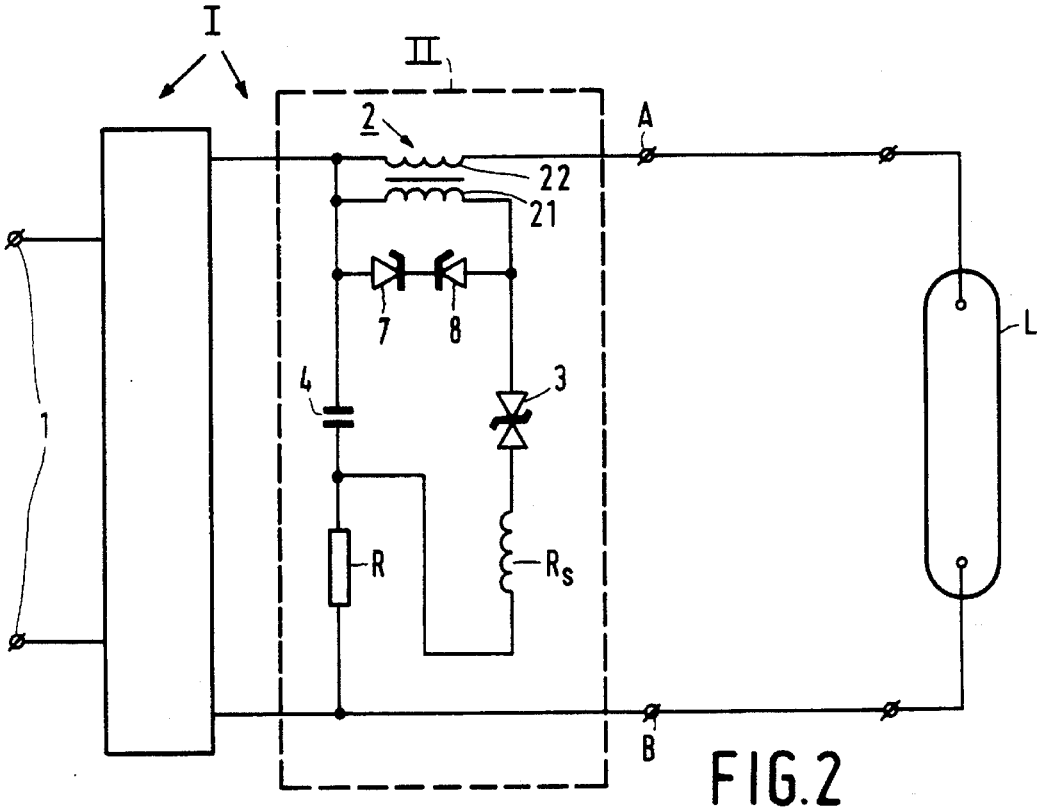
FIG. 2 shows a lamp operating circuit provided with a modification of a circuit arrangement according to the invention.

FIG. 2 shows a modification of circuit arrangement II in which parts corresponding to those of FIG. 1 have the same reference numerals. A charge change in the form of a discharge of capacitor 4 in this modification takes place in the separate closed electric circuit of primary winding 21, breakdown element 3 and self-inductance $R_s$. Charging of capacitor 4 via resistor R takes place during the period before breakdown of the breakdown element 3. Substantially no voltage doubling occurs in this modification of circuit arrangement II. Therefore, the breakdown voltage level of the breakdown element 3 will have to be chosen below the maximum voltage supplied to the circuit arrangement II. Thus in this circuit arrangement II the breakdown element will have a lower breakdown voltage level, for example, 200 V.

I claim:

1. A circuit arrangement for igniting a high-pressure discharge lamp, comprising: pulse transformer means, switching means and capacitive means coupled to the pulse transformer means so as to provide for periodic charge change of the capacitive means via the transformer means and switching means, and peak current limiting means connected in the circuit so as to protect the switching means, characterized in that voltage limiting means are coupled to the transformer means.

2. A circuit for igniting a high pressure discharge lamp comprising:

a pair of input terminals for connection to a source of AC voltage, a pair of output terminals for connection to a high pressure discharge lamp, means for coupling said input terminals to said output terminals via at least a first winding of a transformer, an ignition capacitor, means for coupling said ignition capacitor to said input terminals, switching means for coupling the ignition capacitor to a second winding of said transformer so as to generate a high voltage ignition pulse in said first winding for igniting a high pressure discharge lamp when connected to said pair of output terminals, means coupled to the switching means for limiting the current therein so as to protect the switching means, and means coupled to one of said transformer windings for limiting the voltage developed therein upon discharge of the ignition capacitor into said second winding of the transformer and via said switching means.

3. A circuit arrangement as claimed in claim 1, wherein the voltage limiting means are connected as a short-circuit across the transformer means.

4. A lamp ignition circuit as claimed in claim 2 which is adapted to operate reliably with different lengths of connection lines between said pair of output terminals and the terminals of a high pressure discharge lamp to be connected thereto.

5. A lamp ignition circuit as claimed in claim 2 wherein the voltage limiting means are connected so as to provide a short-circuit across at least one of said transformer windings when the voltage at said voltage limiting means exceeds a predetermined threshold voltage.

6. A lamp ignition circuit as claimed in claim 5 wherein the voltage limiting means comprise first and second zener diodes serially connected with reverse polarities.

7. A lamp ignition circuit as claimed in claim 6 wherein the switching means comprise a bidirectional voltage breakdown device.

8. A lamp ignition circuit as claimed in claim 5 wherein the second winding of the transformer comprises the transformer primary winding, and wherein said primary winding, said switching means, said ignition capacitor and said current limiting means are serially connected to said pair of input terminals.

9. A lamp ignition circuit as claimed in claim 8 wherein the voltage limiting means comprise first and second zener diodes serially connected with reverse polarities across said primary winding of the transformer.

10. A lamp ignition circuit as claimed in claim 5 wherein the second winding of the transformer comprises the transformer primary winding, wherein said primary winding, said switching means, and said current limiting means are serially connected to said pair of input terminals, and said ignition capacitor is connected in parallel with the series connection of the primary winding, the switching means and the current limiting means.

11. A lamp ignition circuit as claimed in claim 2 wherein said coupling means includes a switched mode power supply coupled between said pair of input terminals and said transformer.

12. A lamp ignition circuit as claimed in claim 2 wherein a first terminal of the first winding and a first terminal of the second winding are directly connected to one another.

13. A lamp ignition circuit as claimed in claim 2 wherein the switching means comprise a two-terminal bidirectional voltage breakdown device and said current limiting means comprises an inductor connected in series with the voltage breakdown device.

14. A lamp ignition circuit as claimed in claim 2 wherein the voltage limiting means comprise first and second zener diodes serially connected with reverse polarities directly across the second winding of the transformer.

15. A lamp ignition circuit as claimed in claim 5 which is adapted to operate reliably with different lengths of connection lines between said pair of output terminals and the terminals of a high pressure discharge lamp to be connected thereto, and wherein said predetermined threshold voltage is determined, at least in part, by the impedance of said connection lines.

* * * * *